United States Patent [19]

Oyobe et al.

[11] Patent Number: 4,723,973

[45] Date of Patent: Feb. 9, 1988

[54] PURIFYING APPARATUS OF A PARTICULATE TRAP-TYPE FOR COLLECTING PARTICULATES IN EXHAUST GAS FROM AN ENGINE

[75] Inventors: Kazuo Oyobe, Oobu; Hiroki Hoshizaki, Anjyo; Terutaka Kageyama; Hirofumi Suzuki, both of Kariya; Yoshihiko Imamura, Susono; Kiyoshi Kobashi, Mishima; Kenichiro Takama; Shinichi Takeshima, both of Susono, all of Japan

[73] Assignees: Nippondenso Co., Ltd., Kariya; Toyota Jidosha Kabushiki Kaisha, Toyota, both of Japan

[21] Appl. No.: 912,061

[22] Filed: Sep. 26, 1986

[30] Foreign Application Priority Data

Sep. 28, 1985 [JP] Japan ..... 60-215557
Sep. 28, 1985 [JP] Japan ..... 60-215558
Sep. 28, 1985 [JP] Japan ..... 60-215559

[51] Int. Cl.[4] ..... B01D 46/00

[52] U.S. Cl. ..... 55/466; 55/523; 55/DIG. 30; 60/311; 219/374; 219/375; 219/381; 219/382; 219/376; 219/552; 219/553

[58] Field of Search ..... 55/267–269, 55/466, 523, DIG. 30; 60/311; 219/78.11, 205, 360, 531, 381–382, 375, 374, 376, 552, 553

[56] References Cited

U.S. PATENT DOCUMENTS 4,505,107 3/1985 Yamaguchi et al. ..... 55/466
4,523,935 6/1985 Takagi et al. ..... 55/DIG. 30
4,548,625 10/1985 Ishida et al. ..... 60/311
4,671,058 6/1987 Yoshida ..... 55/466

FOREIGN PATENT DOCUMENTS 60-127685 8/1985 Japan .

*Primary Examiner*—Bernard Nozick
*Attorney, Agent, or Firm*—Cushman, Darby & Cushman

[57] ABSTRACT

An exhaust-gas purifying apparatus according to the present invention comprises an exhaust-gas filter for trapping particulates in exhaust gas from an engine, and a heating device located on the upper-course side of the filter, with respect to the flowing direction of the exhaust gas, the heating device including one or more conductive-ceramic heater elements, capable of heating and burning the particulates caught by the filter, and a heater case for holding the heater elements in position, so that the caught particulates are heated and burned by the heater elements when the flow resistance of the exhaust gas, flowing through the filter, is increased by the caught particulates, whereby the flow resistance is reduced. The heater element includes a fixed electrode portion, immovably fixed to the heater case, and a slidable electrode portion held slidably. An electrode member, fixed to the heater case, is brazed to the fixed electrode portion, and the heater element is bonded to the electrode member, so as to be clamped from both sides by solidified molten solder. The slidable electrode portion is supported by the heater case, for sliding motion in the direction of thermal deformation, so that the working life of the heater element is prolonged.

8 Claims, 30 Drawing Figures

PURIFYING APPARATUS OF A PARTICULATE TRAP-TYPE FOR COLLECTING PARTICULATES IN EXHAUST GAS FROM AN ENGINE

BACKGROUND OF THE INVENTION

A. Field of the Invention

The present invention relates generally to a so-called particulate trap, which catches particulates, contained in exhaust gas from a diesel engine or the like, by means of a filter, and burns the caught particulates to recover the initial flow resistance of the filter, and more specifically to an exhaust-gas purifying apparatus of the particulate trap-type.

B. Description of the Prior Art

Stated in Japanese Patent Disclosure No. 60-127685 is a support structure for heat generating members, formed of heat-resistant material.

The prior art invention relates to a heater for heating a vacuum degassing furnace, using fragile carbon electrodes. Each carbon electrode is a hollow, cylindrical electrode, one end of which is supported on a support structure, by means of a coupling member fitted in the electrode. The other end of the electrode is supported mechanically on a copper pipe, inserted therein, by means of a clamping cap. Thus, the electrode is supported like a cantilever, as a whole. Both ends of the carbon electrode are connected to a current source, by means of the coupling member and the copper pipe, individually.

This arrangement, in which the carbon electrodes are cantilevered, is advantageous in that the electrodes require no center-alignment, and can enjoy a prolonged working life.

The aforesaid conventional support structure cannot, however, support conductive-ceramic heater elements in a particulate trap. Since conductive ceramic is a highly brittle material, the cantilever structure tends to cause breakage of the heater elements. If the heater elements are hollow, moreover, they can be easily broken by stress, due to thermal expansion caused by heating.

SUMMARY OF THE INVENTION

Accordingly, an object of the present invention is to provide an exhaust-gas purifying apparatus, with an arrangement for supporting conductive-ceramic heater elements, capable of prolonging the working life of the heater elements.

Another object of the invention is to provide a purifying apparatus, with an arrangement for supporting electrode portions, in which the bonding strength of electrode members is improved, ceramic material of heater elements cannot be exfoliated by vibration, and stable electric resistance can be retained after prolonged use.

Still another object of the invention is to provide a purifying apparatus with electrode portions, in which electrode members cannot be separated even though heater elements are heated to high temperature.

A further object of the invention is to provide a purifying apparatus, in which electrode portions of heater elements are subject to only a minor change of thermal stress.

In order to achieve the above objects of the present invention, there is provided an exhaust-gas purifying apparatus, which comprises an exhaust-gas filter for trapping particulates in exhaust gas from an engine, and a heating device located on the upper-course side of the filter, with respect to the flowing direction of the exhaust gas, the heating device including one or more conductive-ceramic heater elements, capable of heating and burning the particulates caught by the filter, and a heater case for holding the heater elements in position, so that the caught particulates are heated and burned by the heater elements when the flow resistance of the exhaust gas, flowing through the filter, is increased by the caught particulates, whereby the flow resistance is reduced, characterized in that the heater element includes a fixed electrode portion, immovably fixed to the heater case, and a slidable electrode portion held slidably. An electrode member, fixed to the heater case, is brazed to the fixed electrode portion, the heater element is bonded to the electrode member, so as to be clamped from both sides by solidified molten solder, and the slidable electrode portion is supported by the heater case, for sliding motion in the direction of thermal deformation, so that the working life of the heater element is prolonged.

According to an aspect of the invention, an electrode member, movable, relative to the heater case, is brazed to the slidable electrode portion of the heater element, the heater element is bonded to the movable electrode member, so as to be clamped from both sides by solidified molten solder, and the movable electrode member is provided with a projection, the tip end of which is connected with a lead wire. In connecting the lead wire to the movable electrode member, therefore, the solder for bonding the heater element to the electrode member cannot be melted.

The electrode portions of the heater element communicate with an exhaust-gas passage by means of a communicating passage, so that a change of thermal stress on the electrode portions is diminished, thus preventing the heater element from breaking.

BRIEF DESCRIPTION OF THE DRAWINGS

The present invention will be apparent in the following detailed description which is to be read in connection with the accompanying drawings, in which.

DETAILED DESCRIPTION OF THE PREFERRED EMBODIMENTS

[First Embodiment]

Figure 2:
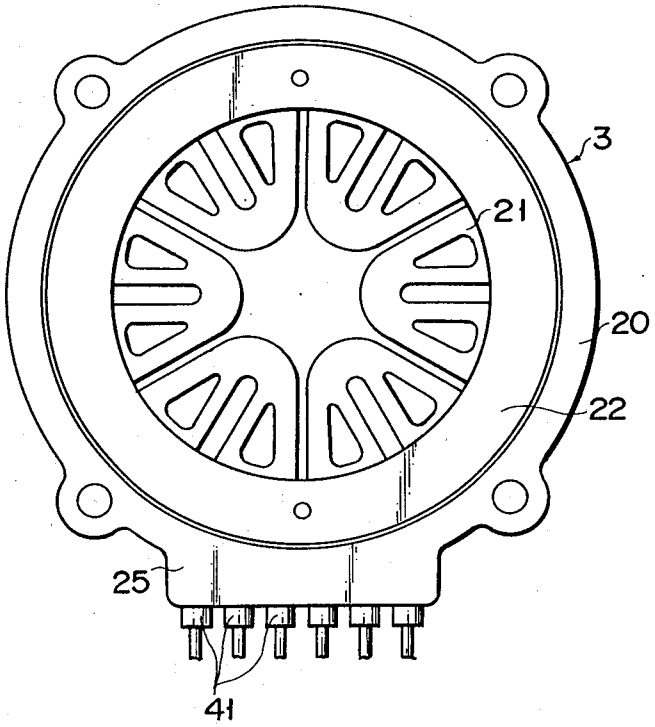
FIG. 2 is a plan view of a heating device of the particulate trap of FIG. 1.
Figure 1:
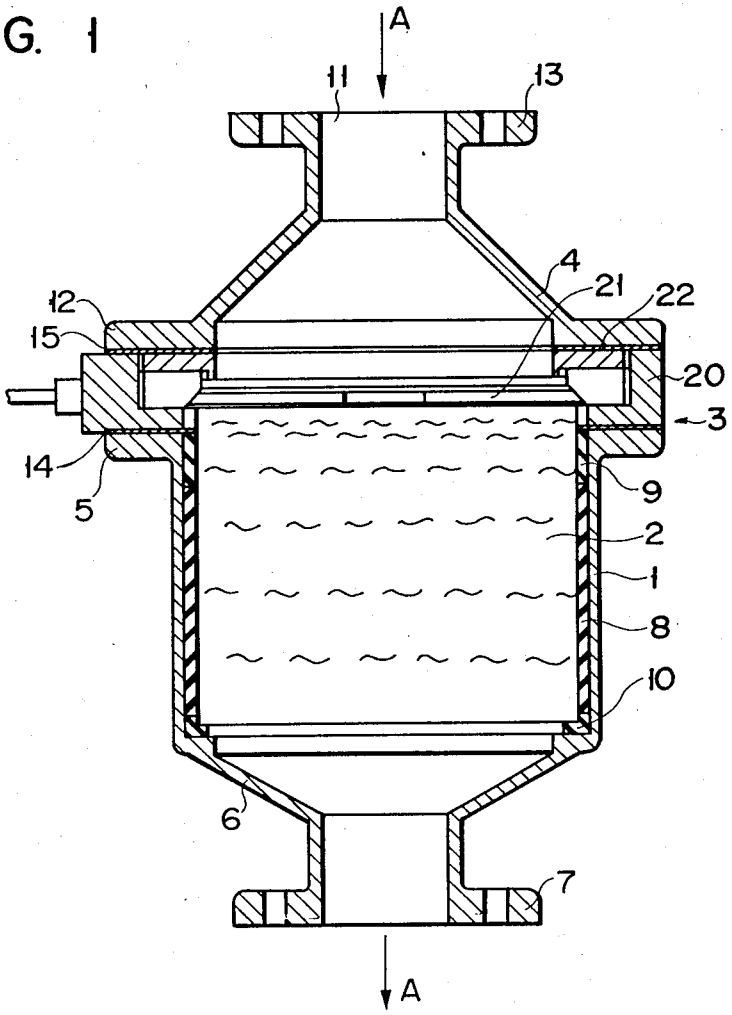
FIG. 1 is a sectional view of a particulate trap according to an embodiment of the present invention.
Figure 2A:
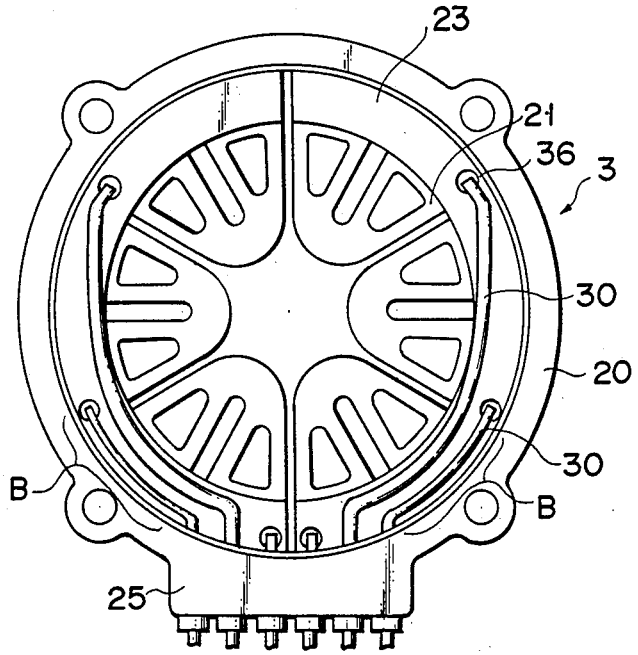
FIG. 2A is a plan view of the heating device, with its retaining cap removed.
Figure 3:
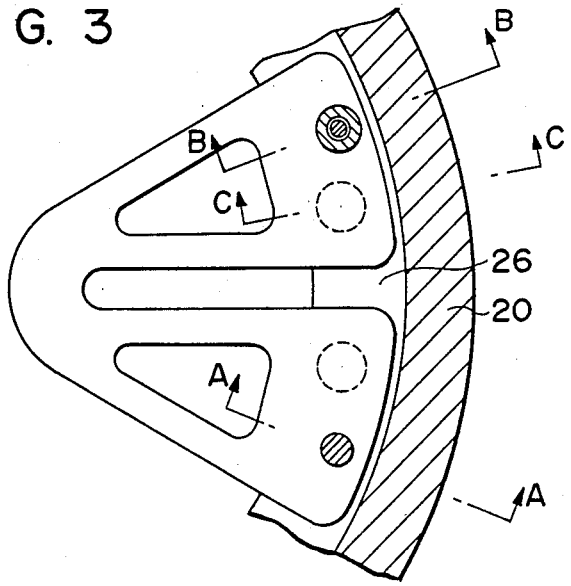
FIG. 3 is a plan view of a mounting portion for a heater element shown in FIG. 2.

Referring now to FIGS. 1 to 7, there is shown a particulate trap according to a first embodiment of the present invention, which catches particulates in exhaust gas from a diesel engine, thereby purifying the gas. The particulate trap mainly comprises filter case 1, filter 2, heating device 3 located on the upper-course side of filter 2, with respect to the flowing direction of the exhaust gas, and exhaust-gas intake pipe 4.

Filter case 1 is a substantially cylindrical member, formed of a casting. Flange 5 is formed at one end of case 1, while exhaust-gas discharge pipe 6 is formed integrally with the other end of the case. Flange 7 is formed on the delivery side of pipe 6.

Filter case 1 is loaded with filter 2, with the aid of adiabatic cushion member 8 and adiabatic sealing members 9 and 10. For example, filter 2 is formed of porous ceramic foam of cordierite.

Exhaust-gas intake pipe 4 has exhaust-gas inlet port 11 at one end, and flanges 12 and 13 at two opposite ends.

Heating device 3 is mounted between flange 5 of filter case 1 and flange 12 of exhaust-gas intake pipe 4, with sealing members 14 and 15 interposed between them.

Flange 7 of exhaust-gas discharge pipe 6 of filter case 1, and flange 13 of intake pipe 4, are connected individually to exhaust pipes (not shown) of the diesel engine. The exhaust gas from the engine flows in the direction indicated by arrows A of FIG. 1.

Referring now to FIGS. 2 to 6, the construction of heating device 3 will be described.

Heating device 3 includes heater case 20, one or more conductive-ceramic heater elements 21 (six in number, according to this embodiment), insulating ring 23 put over the heater elements, and retaining cap 22 clamping the insulating ring.

Heater elements 21 are arranged individually on substantially sectorial, equal parts of the end face of filter 2, on the upper-course side thereof. Each element 21 is substantially V-shaped, having two ends spread out. The exhaust gas circulates through gaps between elements 21. Positive and negative electrodes 24*a* and 24*b* are brazed individually to the spread end portions, thus constituting electrode portions.

Electrodes 24*a* and 24*b* of the electrode portions, at the end portions of each heater element 21, have flange portion 60 each. Thus, each electrode has a cruciform section. The trunk 61 of each electrode is inserted into an insertion hole, in its corresponding electrode portion, for brazing. If melted solder solidifies, in brazing the electrodes, it holds each heater element 21 from both sides thereof, since solder has a higher thermal expansion coefficient than conductive ceramic, which forms the heater elements. As a result, the heater elements are compressed by the solder, thus enjoying improved strength of bonding with the electrodes.

Heater elements 21 are manufactured as follows. A slurry is prepared by dispersing, for example, 30 percent TiN powder and 70 percent $Si_3N_4$, by weight, in an organic binder, formed of polyvinyl butyral, dibutyl phthalate, and ethanol. Subsequently, the slurry is formed into a plate by the doctor-blade method, and then stamped into pieces of a predetermined shape. Thereafter, the stamped pieces are sintered in an inert-gas atmosphere, such as nitrogen gas, at a temperature of about 1,750° C., for 2 hours or thereabout. Thus, the heater elements are completed.

Figure 7:
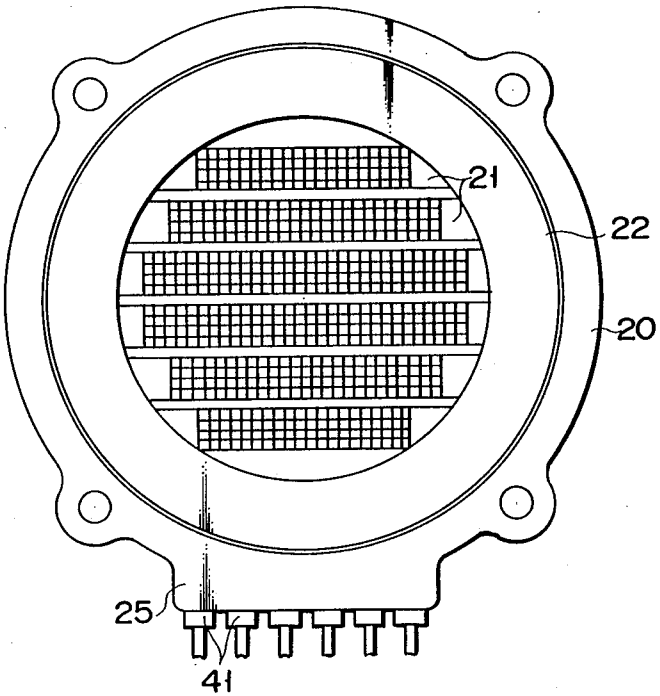
FIG. 7 is a plan view, similar to FIG. 2, showing a modification of the heater elements.
Figure 9:
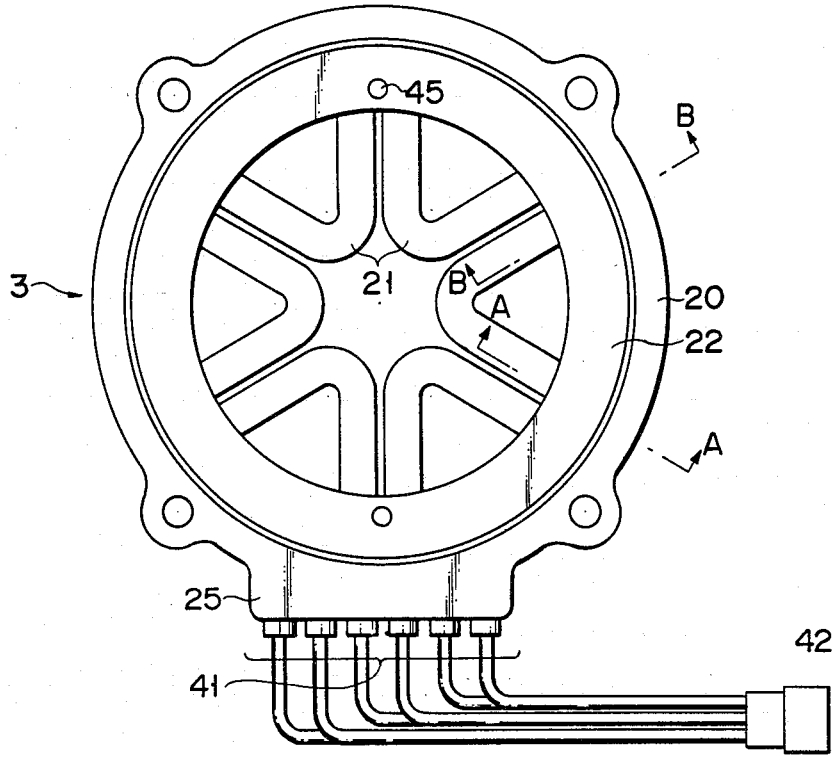
FIG. 9 is a plan view of a heating device of the particulate trap of FIG. 8.
Figure 10:
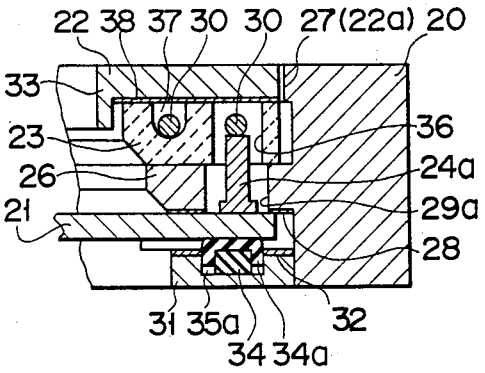
FIGS. 10 and 11 are sectional views taken along lines A—A and B—B of FIG. 9, respectively.
Figure 11:
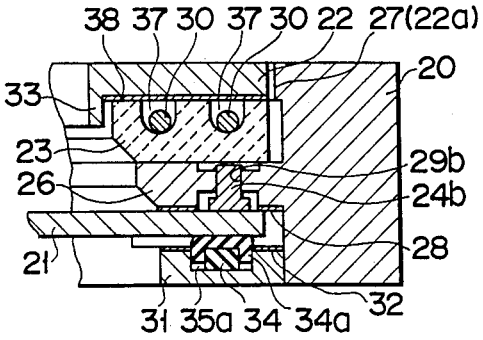
Figure 12:
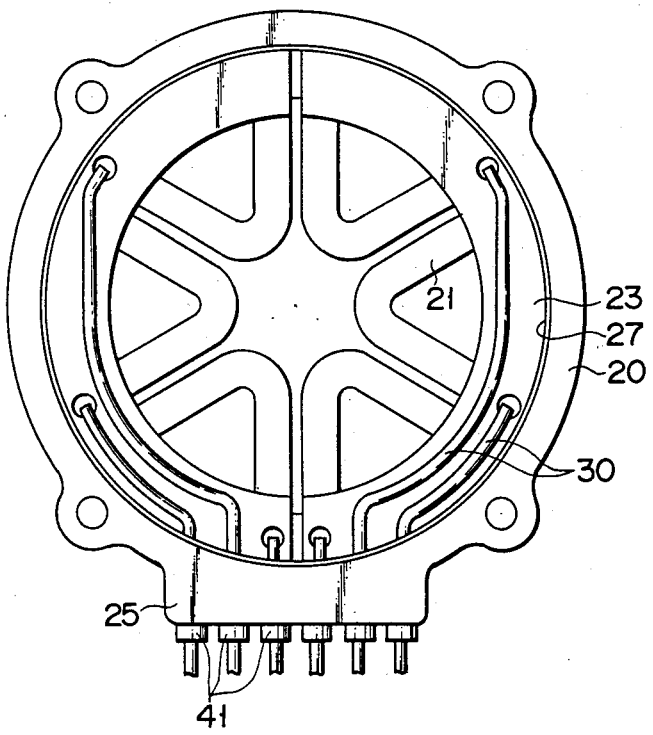
FIG. 12 is a plan view of the heating device, with its retaining cap removed.

Conductive-ceramic heater elements 21, constructed in this manner, are supported, at both ends, on heater case 20. The respective heat generating sections of heater elements 21 are directed toward the center of an exhaust passage. Thus, elements 21 are arranged at intervals, in the circumferential direction of the exhaust passage. In this arrangement, gaps are defined between adjacent heat generating sections. These gaps and the regions surrounded by the V-shaped portions, form a passage through which the exhaust gas flows. As shown in FIG. 7, the heater elements may alternatively have a honeycomb configuration.

An arrangement for mounting heater elements 21 on heater case 20 will now be described.

Figure 4:
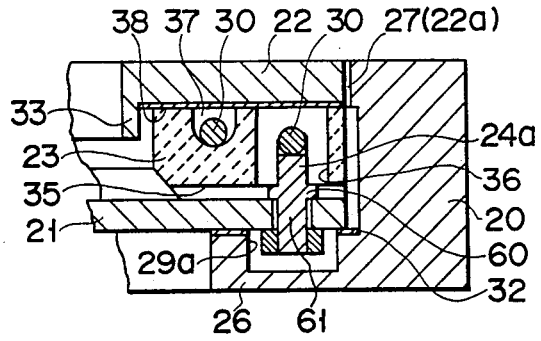
FIGS. 4, 5 and 6 are sectional views taken along lines A—A, B—B and C—C of FIG. 3, respectively.
Figure 5:
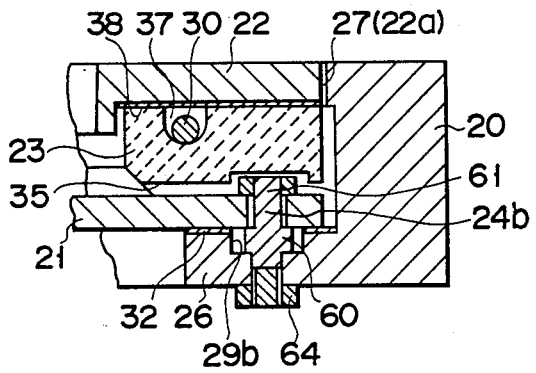
Figure 6:
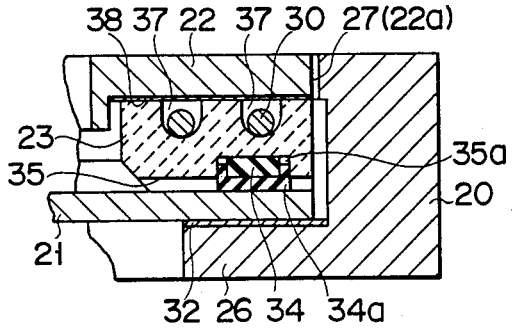
Figure 8:
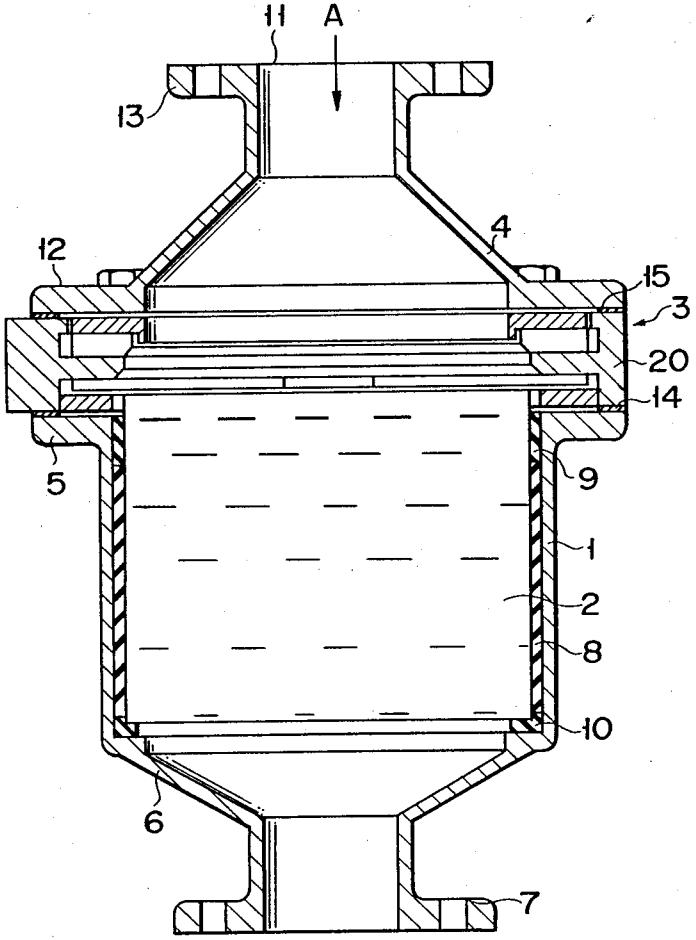
FIG. 8 is a general sectional view of a particulate trap according to another embodiment of the invention.

Heater case 20 is in the form of a ring made of, e.g., cast iron. Terminal mounting portion 25 is formed on the periphery of case 20. Also, the heater case has a ring-shaped protrusion 26, which protrudes from the lower end portion of the case toward its center, as shown in FIGS. 4 to 6. Internal thread portion 27 is formed on the inner peripheral surface of the upper portion of heater case 20, throughout the circumference.

Insulating film 32 is formed on the upper surface of protrusion 26 by ceramic coating, using spinel, alumina, etc. Electrode holes 29*a* and 29*b* are formed in protrusion 26, at circumferential intervals, so as to receive electrodes 24*a* and 24*b*, respectively.

Electrode holes 29*a* have a diameter greater enough than that of their corresponding electrodes 24*a*, to allow the electrodes to move in both radial and circumferential directions thereof. Holes 29*b* have a size such that electrodes 24*b* can be passed through them. Each electrode 24*a* is loosely fitted in its corresponding hole 29*a*, and nickel lead wire 30 is welded to the upper end of electrode 24*a*, thus forming a positive electrode. Each electrode 24*b* is passed through its corresponding hole 29*b*, and fixed to protrusion 26 by means of nut 64, thus forming an earth electrode.

Accordingly, electrodes 24*a* are movable, relative to protrusion 26, while electrodes 24*b* are fixed to the protrusion. In other words, one end of each heater element 21 is movable, relative to heater case 20, while the other end is fixed firmly to the case.

Heater elements 21, mounted on protrusion 26 of heater case 20 in this manner, are retained by retaining cap 22, with the aid of insulating ring 23.

Retaining cap 22 has external thread portion 22*a*, on its outer peripheral surface, which engages internal thread portion 27 of heater case 20. Retaining wall 33 protrudes downward from the inner peripheral portion of cap 22, thus retaining insulating ring 23. Insulating film 38 is formed on the undersurface of cap 22 by ceramic coating, using spinel, alumina, etc.

In this embodiment, insulating ring 23, which is formed of insulating ceramic, such as silicon nitride or alumina, is circumferentially divided in two. The ring-shaped configuration of ring 23, for the entire circumference, is maintained by butting the halves.

Heater insertion grooves 35, extending in the radial direction of insulating ring 23, are formed on the undersurface of ring 23. The end portions of heater elements 21 are adapted to be inserted individually into grooves 35.

As shown in FIGS. 4 to 6, each insertion groove 35 has a size such that a gap is formed between the groove and its corresponding heater element 21. This gap constitutes a communicating passage, which connects the electrode portions of each heater element and the exhaust passage.

Moreover, insulating ring 23 is formed with electrode insertion holes 36, which face electrodes 24*a* on heater elements 21. Guide grooves 37 for lead wires are formed on the top surface of ring 23, so as to connect with holes 36. The other ends of grooves 37 lead to terminal mounting portion 25 of heater case 20, corresponding to terminals 41.

Further, recesses 35*a* are formed in electrode insertion grooves 35, on the underside of insulating ring 23, at positions deviated from electrodes 24*a* and 24*b*, as viewed from above heater elements 21. These recesses each hold therein cushion member 34 and insulating ceramic cap 34*a*, covering the same.

The particulate trap or purifying apparatus of the present invention is completed by setting heating device 3, with the aforementioned construction, on the upper-course side of filter 2.

Constructed in this manner, the purifying apparatus of this embodiment is coupled to an exhaust system of the engine. The exhaust gas is introduced from exhaust-gas inlet port 11 of exhaust-gas intake pipe 4, and particulates in the exhaust gas are caught by filter 2. If pores of filter 2 are narrowed or clogged by the particulates on the surface of the filter, electric current is supplied to lead wires 30 through connector 42.

In this case, the electric current is supplied to lead wires 30, intermittently and in regular succession. As a result, heater elements 21 successively produce heat in an intermittent manner. As the heat is produced in this manner, the upper-course-side end face of filter 2 is heated, so that the particulates on the end face start to burn, thus constituting a combustion point. Accordingly, the particulates on the lower-course-side surface of filter 2 are also burned and removed. Thus, filter 2 is regenerated.

According to the arrangement described above, heater elements 21 are held between protrusion 26 of heater case 20 and insulating ring 23. Electrode 24*a*, one of the two electrodes attached to both ends of each element 21, is loosely fitted in its corresponding electrode hole 29*a*, for movement. Electrode 24*b* is passed through hole 29*b* and fixed to protrusion 26, thus constituting an earth electrode. In this arrangement, one end of each heater element 21 is movable, relative to heater case 20, while the other end is fixed firmly to the case. Moreover, each element 21 is slidably supported between protrusion 26 and insulating cap 34*a* on insulating ring 23. Accordingly, the one end is slidable, while the other end is fixed securely.

If heater elements 21 undergo thermal expansion and contraction, affected by self-heating and the heat of the exhaust gas, the one end of each element 21 slides in the radial and circumferential directions, thereby permitting the expansion and contraction. Thus, elements 21 can be prevented from being broken by stress.

Although slidable at the one end, each heater element 21 is supported mechanically between protrusion 26 and insulating cap 34*a*. Thus, supported at both ends, the heater elements are stable against vibration or impact.

Lead wires 30 can be less rigid if they are each formed of a stranded cable, consisting of a plurality of fine strands. With use of these wires, the one end of each heater element 21 can slide more easily.

The electrode portions, at both ends of each heater element 21, are brazed to electrodes 24*a* and 24*b*, in a manner such that they are clamped from both sides. Therefore, only compressive stress, which is not substantial at all, acts on the joints between the electrodes and electrode portions. Accordingly, the conductive ceramic material of elements 21 cannot easily break. Thus, the fixed electrode portions, including electrodes 24*b* fixed to heater case 20, can enjoy stable electric resistance for a long period of time, without entailing exfoliation of the ceramic material, even when they are subjected to a strong vibration. Since the other electrode portions of heater elements 21 are slidable, they can absorb thermal deformation, caused by heating, and can resist vibration well.

At the slidable electrode portions, the lead wire is connected to the tip end of each electrode 24*a*. While brazing the wire, therefore, the brazed portion of electrode 24*a* cannot melt.

Moreover, the electrode portions of heater elements 21 connect with the exhaust passage, by means of the communicating passages, which are formed in insertion grooves 35 of insulating ring 23. If elements 21 are energized and heated to high temperature, therefore, they can be cooled by the exhaust gas. Accordingly, the difference between the maximum and minimum temperatures is reduced, so that the thermal stress lessens. Thus, the heater elements are prevented effectively from breaking.

[Second Embodiment]

Referring now to FIGS. 8 to 13, a second embodiment of the present invention will be described.

A purifying apparatus according to this embodiment, like the particulate trap of the first embodiment, mainly comprises filter case 1, filter 2, heating device 3 located on the upper-course side of filter 2, with respect to the flowing direction of the exhaust gas, and exhaust-gas intake pipe 4. In the description to follow, like reference numerals are used to designate like portions.

Only points of difference from the first embodiment will be described below.

In the second embodiment, protrusion 26 protrudes from the middle portion of heater case 20, as in the vertical direction thereof, toward the center. Substantially V-shaped heater element 21, made of conductive-ceramic material, is held between protrusion 26 and retaining ring 31, which is fixed to heater case 20, below the protrusion.

Retaining ring 31, which is made of metal, is attached to heater case 20 by means of bolts (not shown). Insulating film 32 is formed on the upper surface of ring 31 by ceramic coating, using spinel, alumina, etc. Also, recesses 35*a* are formed in the upper surface of ring 31, at positions facing electrodes 24*a* and 24*b*. Each recess 35*a* holds therein cushion member 34 and insulating cap 34*a*.

Figure 13:
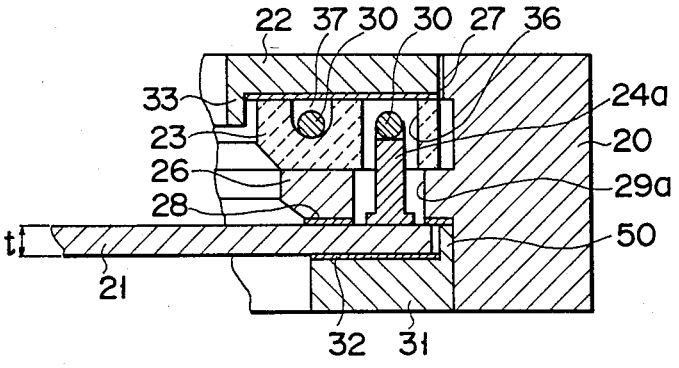
FIG. 13 is a sectional view, similar to FIG. 10, showing a modified manner of mounting heater elements on a heater case.

FIG. 13 shows a modification of retaining ring 31, which is not formed with the recesses holding insulating caps 34*a* and cushion members 34. Spacer portion 50, having a height a little greater than the thickness (t) of heater element 21, is formed along the outer periphery of ring 31. Thus, the bearing pressure for element 21 is reduced. The spacer portion may be formed integrally with or independently of ring 31.

Insulating ring 23 is formed with electrode insertion holes 36, communicating with electrode holes 29*a* in which electrodes 24*a* are fitted loosely. Holes 36 are large enough to allow electrodes 24*a* to move circumferentially and radially therein.

Lead wires 30, connected to the tip ends of positive electrodes 24*a*, are passed through guide grooves 37, on the upper surface of insulating ring 23, and connected to connector 42 via terminals 41, which are attached to mounting portion 25 of heater case 20.

In this embodiment, electrodes 24*a* and 24*b* are mounted only on the upper surface of each heater element 21, by brazing. As in the case of the first embodiment, however, they may be mounted so as to penetrate element 21 and be held between the opposite sides of element 21.

In the arrangement as illustrated, insulating ring 23 is circumferentially divided in two. Alternatively, however, it may be divided into three or more parts, or formed into a single, integral body. Also, two such insulating rings may be arranged so as to hold heater element 21 between them. In this case, the insulating film, formed by ceramic coating, can be omitted.

Thus, according to the second embodiment, one electrode portion of each conductive-ceramic heater element 21 is fixed, to serve as an earth electrode, whereby heater case 20 can be energized. The other electrode portion is supported by the insulator, so as to be slidable in the direction of thermal expansion, and the lead wire 30 is connected to the slidable electrode portion. Therefore, heater element 21 can undergo thermal expansion and contraction, thereby preventing production of stress. Since the slidable electrode portion is supported mechanically, the heater element is improved in vibration-proof property. In consequence, heater element 21 is protected against damage, thus enjoying higher reliability.

[Third Embodiment]

Referring now to FIGS. 14 to 29, a third embodiment of the present invention will be described.

Figure 14:
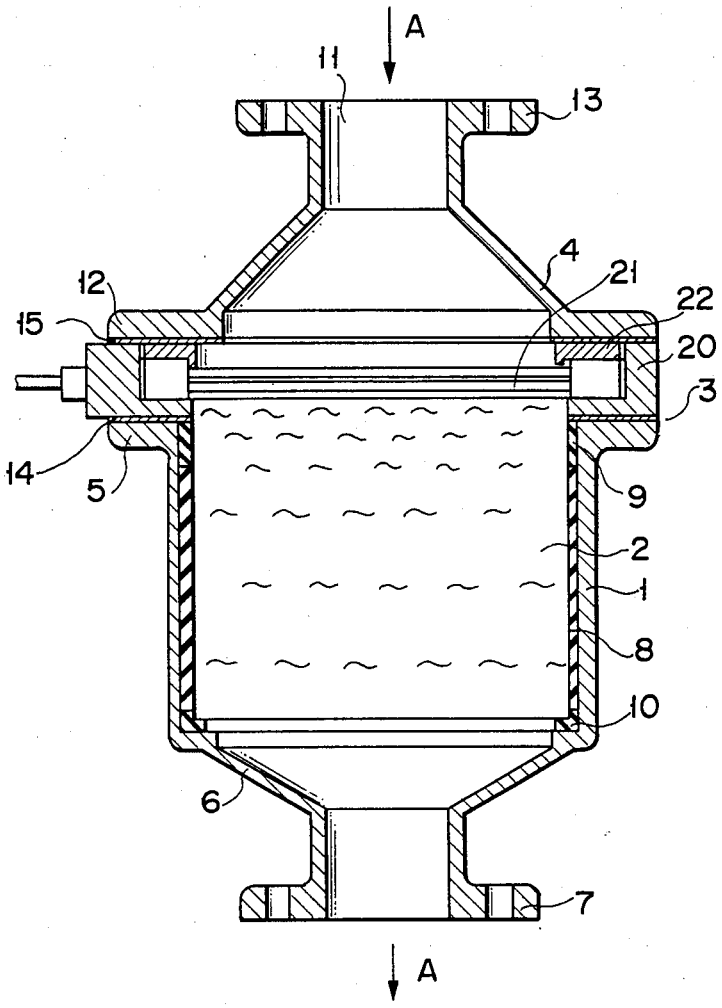
FIG. 14 is a general sectional view of a particulate trap according to still another embodiment of the invention.
Figure 15:
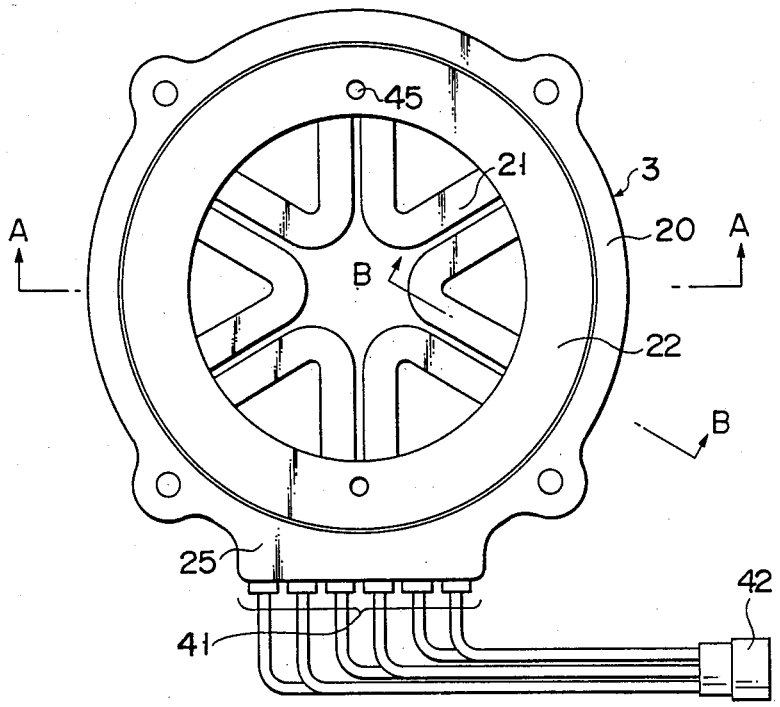
FIG. 15 is a plan view of a heating device of the particulate trap of FIG. 14.

As shown in FIG. 14, a purifying apparatus according to this embodiment, like the ones described in connection with the first and second embodiments, mainly comprises filter case 1, filter 2, heating device 3 located on the upper-course side of filter 2, with respect to the flowing direction of the exhaust gas, and exhaust-gas intake pipe 4.

Heating device 3 is held between flange 5 of filter case 1 and flange 12 of exhaust-gas intake pipe 4, with adiabatic sealing members 14 and 15 interposed between them.

Referring now to FIGS. 15 to 19, the construction of heating device 3, according to this embodiment, will be described.

Heating device 3 includes heater case 20, one or more conductive-ceramic heater elements 21, e.g., six in number, retaining cap 22 holding elements 21 between itself and case 20, and insulating ring 23 interposed between cap 22 and elements 21.

Figure 18:
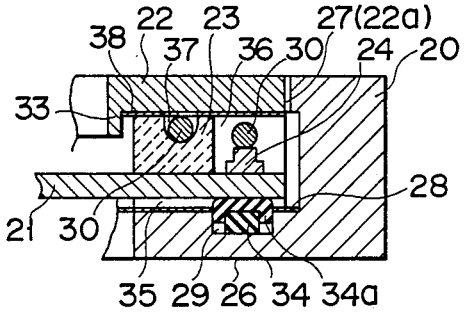
Figure 19:
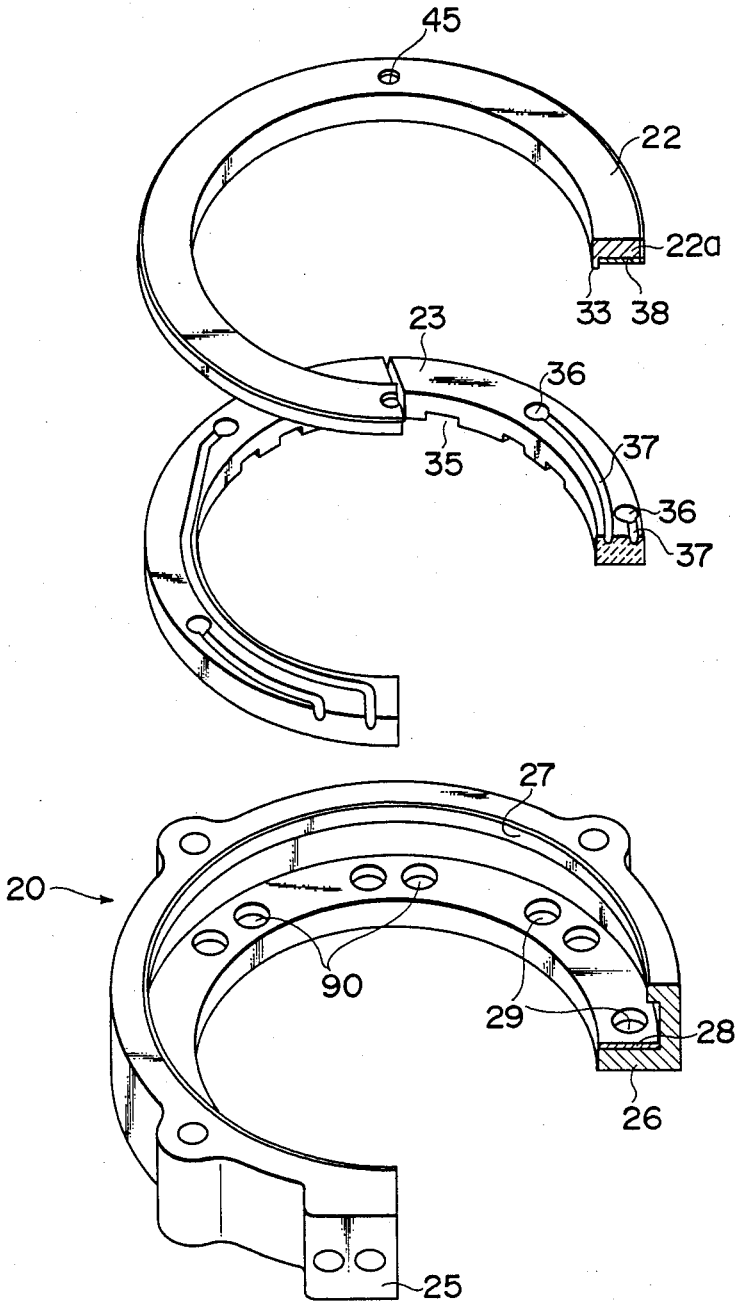
FIG. 19 is an exploded view of the heating device, with its heater elements removed.

Heater elements 21 are arranged individually on substantially sectorial, equal parts of the end face of filter 2, on the upper-course side thereof. Each element 21 has a substantially V-shaped plane configuration. Electrode 24 is brazed to each end portion of the V-shaped element. Electrode 24, bonded to one end portion of element 21, projects upward, as shown in FIG. 18, while the electrode on the other end portion projects downward. The electrodes of this embodiment may be mounted in the same manner as those of the first embodiment.

In each heater element 21, the V-shaped portion, connected to the electrodes, constitute a heat generating section. The exhaust gas can pass through the region surrounded by the V-shaped portion.

Heater elements 21 of the third embodiment can be manufactured in the same manner as those of the first embodiment.

Conductive-ceramic heater elements 21, constructed in this manner, are supported, at both ends, on heater case 20. The respective heat generating sections of heater elements 21 are directed toward the center of an exhaust passage. Thus, elements 21 are arranged at intervals, in the circumferential direction of the exhaust passage. In this arrangement, gaps are defined between adjacent heat generating sections. These gaps and the regions surrounded by the V-shaped portions, form a passage through which the exhaust gas flows.

An arrangement for mounting heater elements 21 on heater case 20 will now be described.

Heater case 20 is in the form of a ring made of, e.g., cast iron. Terminal mounting portion 25 is formed on the periphery of case 20. Also, the heater case has a ring-shaped protrusion 26, which protrudes from the lower end portion of the case toward its center. Internal thread portion 27 is formed on the inner peripheral surface of the upper portion of heater case 20, throughout the circumference.

Insulating film 28 is formed on the upper surface of protrusion 26 by ceramic coating, using spinel, alumina, etc. Recesses 29 are formed in the upper surface of protrusion 26, at circumferential intervals, so as to face the upward electrodes of heater elements 21. Electrode insertion holes 90 are formed also in the upper surface of protrusion 26, so as to face the downward electrodes of elements 21.

As shown in FIG. 18, each recess 29 contains therein cushion member 34, formed of a wire mesh, and insulating cap 34*a* covering the cushion member.

Ring-shaped metallic retaining cap 22 is screwed in internal thread portion 27 of heater case 20.

Retaining cap 22 has external thread portion 22*a* on its outer peripheral surface, and retaining wall 33 protrudes downward from its inner periphery. Insulating film 38 is formed on the undersurface of cap 22 by ceramic coating, using spinel, alumina, etc.

Numeral 45 designates a hole in which a jig (not shown) is inserted, in attaching or detaching retaining cap 22 to or from heater case 20.

When external thread portion 22a of retaining cap 22 is screwed in internal thread portion 27 of heater case 20, heater elements 21 and insulating ring 23 are held between cap 22 and protrusion 26.

In this embodiment, insulating ring 23, which is formed of insulating ceramic, such as silicon nitride or alumina, is circumferentially divided in two. The ring-shaped configuration of ring 23, for the entire circumference, is maintained by butting the halves.

Heater insertion grooves 35, extending in the radial direction of insulating ring 23, are formed on the undersurface of ring 23. The end portions of heater elements 21 are adapted to be inserted individually into grooves 35. Moreover, insulating ring 23 is formed with electrode insertion holes 36, which face upward electrodes 24 on the first end portions of heater elements 21. Guide grooves 37 for lead wires are formed on the top surface of ring 23, so as to connect with holes 36. The other ends of grooves 37 lead to terminal mounting portion 25 of heater case 20.

The inside diameter of protrusion 26 is equal to or greater than that of the underside of insulating ring 23.

Both end portions of heater elements 21 are inserted individually into heater insertion grooves 35 of insulating ring 23, so that those electrodes bonded to the first end portions of elements 21, are fitted in electrode insertion holes 36. Then, electrodes 24, fitted in holes 36, are welded to lead wires 30, and wires 30 are fitted into guide grooves 37, to be arranged along the same.

Thereafter, heater elements 21 and insulating ring 23 are placed on protrusion 26 of heater case 20, and retaining cap 22 is screwed into case 20. Thereupon, elements 21 and ring 23 are held between protrusion 26 and cap 22. In this state, lead wires 30 are connected to terminals 41 at terminal mounting portion 25. Numeral 42 designates a connector.

When heater elements 21 and insulating ring 23 are held between protrusion 26 of heater case 20 and retaining cap 22, the undersurface of each element 21 is supported by cushion member 34 and insulating cap 34a, as shown in FIG. 18. Practically, therefore, heater elements 21 are held between ring 23 and caps 34a. The downward electrodes (not shown), on the second end portions of elements 21, are inserted into electrode insertion holes 90 of protrusion 26, and welded to protrusion 26, thus constituting earth electrodes.

Although divided in two, insulating ring 23 cannot move, since it is supported by retaining wall 33, protruding downward from retaining cap 22.

The particulate trap or purifying apparatus of the present invention is completed by setting heating device 3, with the aforementioned construction, on the upper-course side of filter 2.

Constructed in this manner, the purifying apparatus of this embodiment is coupled to an exhaust system of the engine. The exhaust gas is introduced from exhaust-gas inlet port 11 of exhaust-gas intake pipe 4, and particulates in the exhaust gas are caught by filter 2. If pores of filter 2 are narrowed or clogged by the particulates on the surface of the filter, electric current is supplied to lead wires 30 through connector 42.

In this case, the electric current is supplied to lead wires 30, intermittently and in regular succession. As a result, heater elements 21 successively produce heat in an intermittent manner. As the heat is produced in this manner, the upper-course-side end face of filter 2 is heated, so that the particulates on the end face start to burn, thus constituting a combustion point. Accordingly, the particulates on the lower-course-side surface of filter 2 are also burned and removed. Thus, filter 2 is regenerated.

According to the arrangement of this embodiment, as seen from FIG. 18, insulating ring 23 is held between protrusion 26 of heater case 20 and retaining cap 22. In this case, the end portions of heater elements 21 are inserted individually into heater insertion grooves 35 of insulating ring 23, and held between ring 23 and insulating caps 34a. Ring 23 is held between the lower surface of retaining cap 22 and the upper surface of protrusion 26. Thus, the upper and lower surfaces of ring 23 are pressed by the wide surfaces of cap 22 and protrusion 26, respectively. Consequently, the insulating ring is held all over the surface, by a uniform clamping force, and cannot be broken by vibration or impact.

Since insulating ring 23 is supported by retaining wall 33, protruding downward from retaining cap 22, it cannot move. Although divided in two, it cannot move, all the same.

Figure 20:
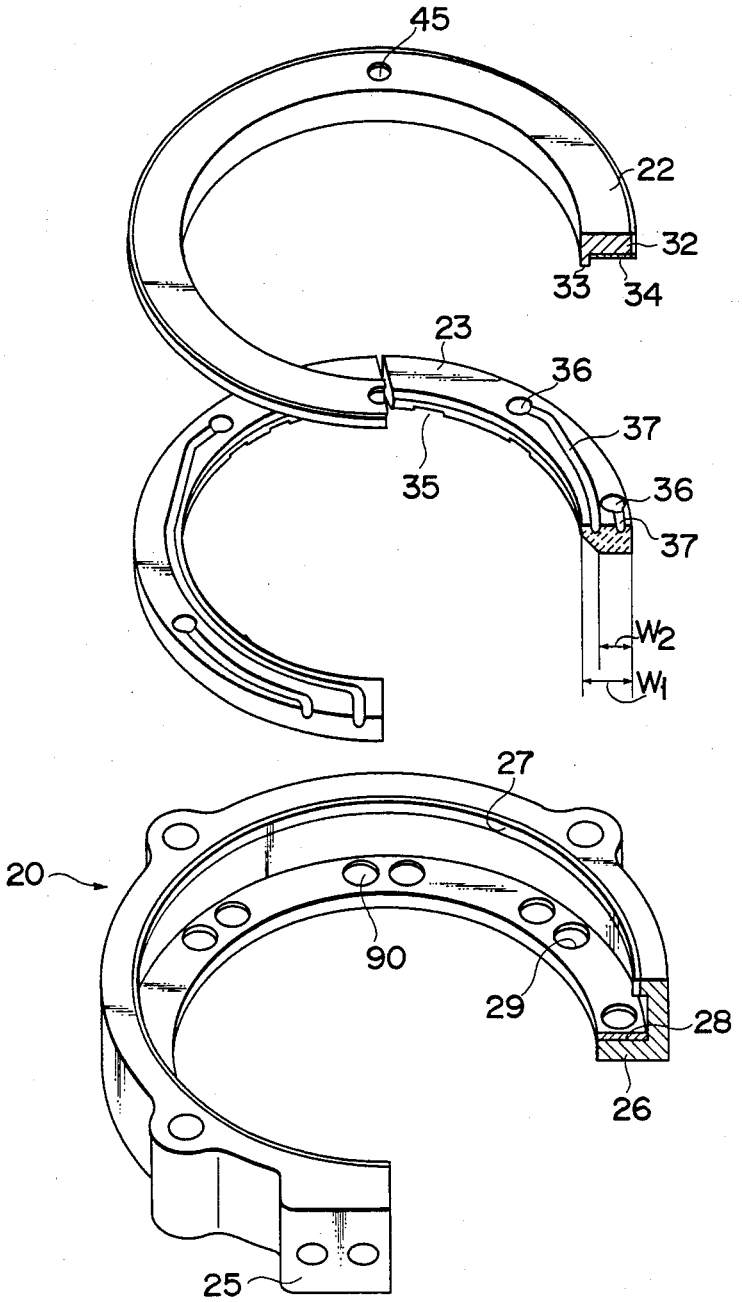
FIG. 20 is an exploded view, similar to FIG. 19, showing a modification of an insulating ring.
Figure 21:
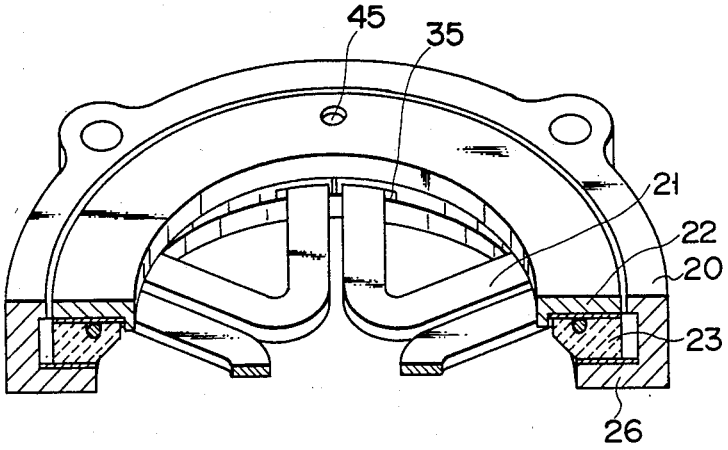
FIGS. 21 and 22 are sectional views, similar to FIGS. 17 and 18, respectively, showing the modification of FIG. 20.
Figure 22:
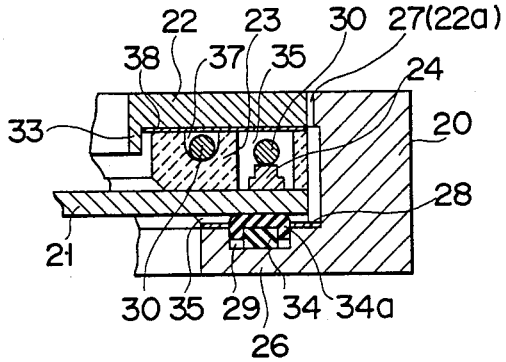

FIGS. 20 to 22 show a modification of insulating ring 23.

Insulating ring 23, according to this modification, has its top width W1 greater than its bottom width W2 ($W1>W2$). The outside diameter of ring 23 is uniform, with respect to the axial direction, while the inside diameter thereof becomes smaller with distance from the bottom. In other words, ring 23 is tapered so that the inside diameter of its end portion on the filter side or the lower-course side, with respect to the flowing direction of the exhaust gas, is greater than that on the upper-course side, opposite to the filter.

Accordingly, top width W1 of insulating ring 23 can be made greater than bottom width W2 ($W1>W2$) without increasing the outside diameter of the ring. A number of lead wires 30 can be arranged on the wide top surface of ring 23.

Figure 16:
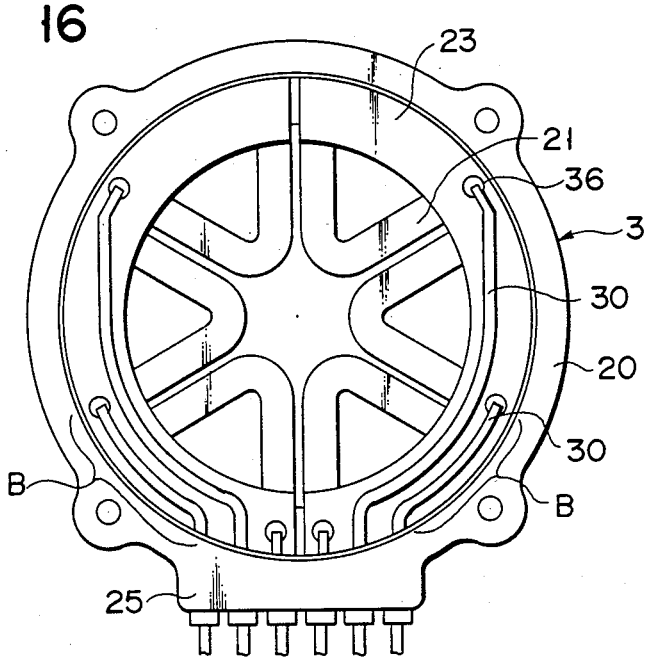
FIG. 16 is a plan view of the heating device, with its retaining cap removed.
Figure 17:
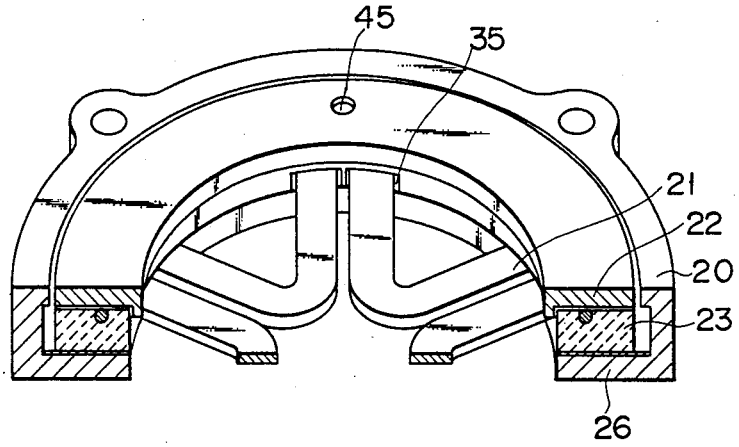
FIGS. 17 and 18 are sectional views taken along lines A—A and B—B of FIG. 15, respectively.

If a plurality of conductive-ceramic heater elements 21 are arranged circumferentially, there are regions B in which a plurality of lead wires 30 are arranged in parallel with one another, as shown in FIG. 16. Since the top surface of insulating ring 23 is relatively wide, however, it can provide a space wide enough to permit the parallel arrangement of the lead wires.

In this case, moreover, the outside diameter of insulating ring 23 need not be increased, so that ring 23 and hence, heater case 20, need not be increased in size, thus constituting no hindrance to the mounting of the apparatus on vehicles.

Since lead wires 30 are arranged on the uppercourse side of heater elements 21, with respect to the flowing direction of the exhaust gas, they are influenced less by heat from elements 21 and heat produced when particulates on filter 2 burn. Therefore, wires 30 are less liable to thermal deterioration, thus enjoying a prolonged life.

Underlying insulating ring 21, moreover, heater elements 21 are located close to filter 2, so that the particulates caught by filter 2 can be burned with improved efficiency.

Furthermore, the inner peripheral surface of insulating ring 23 is tapered against the flow of the exhaust gas, and the inside diameter of protrusion 26 is equal to or greater than that of the bottom of ring 23. Accordingly, the exhaust-gas flow spreads out downward, without being hindered. Also, a sufficient volume of exhaust gas can be guided to the peripheral portion of filter 2, so that the whole region of filter 2 can be utilized effectively for the seizure of the particulates.

Figure 23:
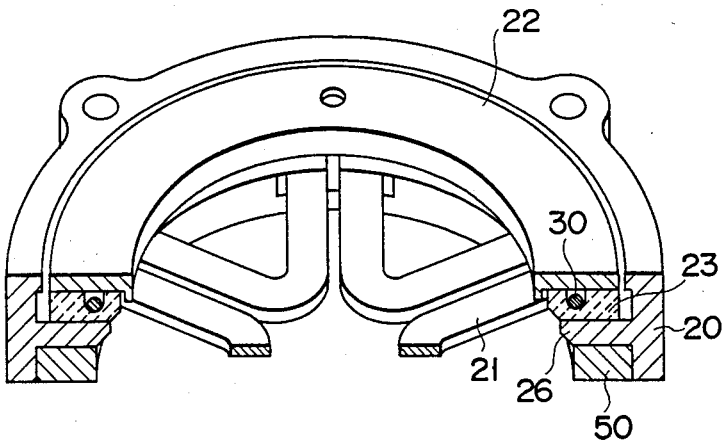
FIGS. 23 and 24 are sectional views, similar to FIGS. 17 and 18, showing another modification.
Figure 24:
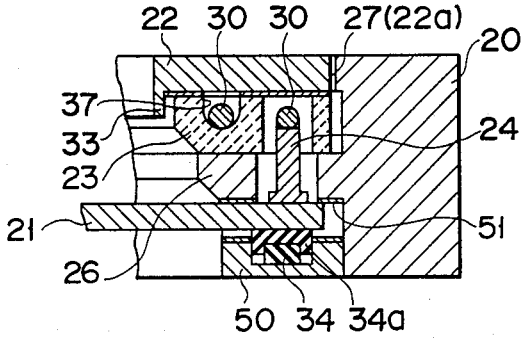

FIGS. 23 and 24 show a modification of heater case 20.

In this modification, protrusion 26 protrudes from the middle portion of heater case 20 toward its center. Insulating ring 23 and lead wires 30 are held between protrusion 26 and retaining cap 22. Conductive-ceramic heater elements 21 are held between protrusion 26 and metallic holder ring 50 thereunder. Ring 50 is fixed to case 20 by means of bolts (not shown).

Insulating film 51 is formed on the lower surface of protrusion 26, by ceramic coating, so that the surface is not electrically in contact with the upper surfaces of heater elements 21.

With use of heater case 20 constructed in this manner, insulating ring 23 need not be formed with heater insertion grooves 35, and therefore, is less liable to break.

Adapted to be held between protrusion 26 and holder ring 50, moreover, heater elements 21 can be mounted independently of insulating ring 23.

Figure 25:
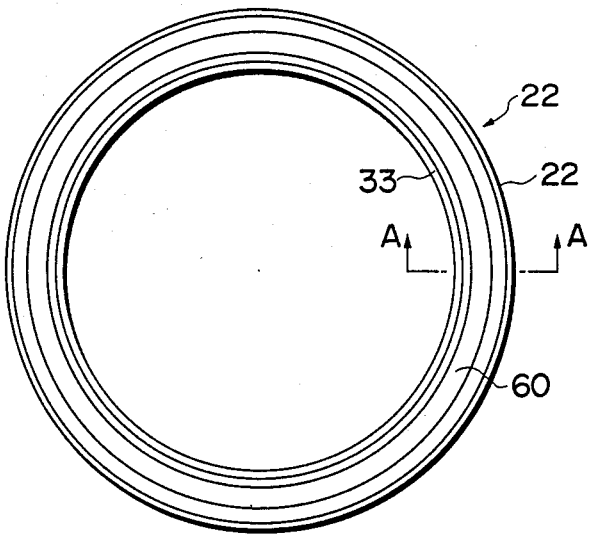
FIG. 25 is a bottom view showing a modification of the retaining cap.
Figure 26:
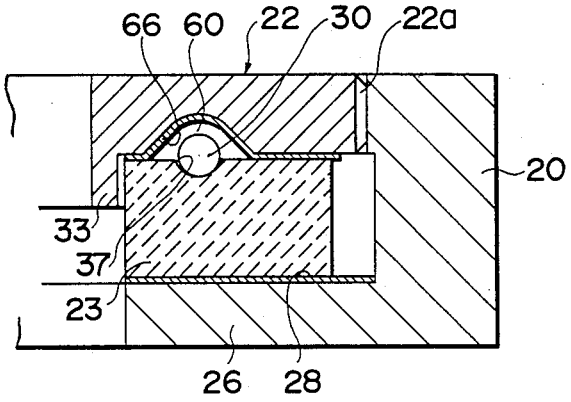
FIG. 26 is a sectional view taken along line A—A of FIG. 25.

FIGS. 25 and 26 show a modification of retaining cap 22.

FIG. 25 is a bottom view of retaining cap 22. As shown also in FIG. 26, wire guide groove 60 is formed on the undersurface of cap 22, throughout the circumference. Insulating film 66 is formed on the inner surface of groove 60 by ceramic coating.

With this arrangement, the depth of guide grooves 37, on the top surface of insulating ring 23, can be reduced, so that ring 23 can be made hard to break, and thinner. Thus, the whole heating device can be reduced in size and weight.

Figure 27:
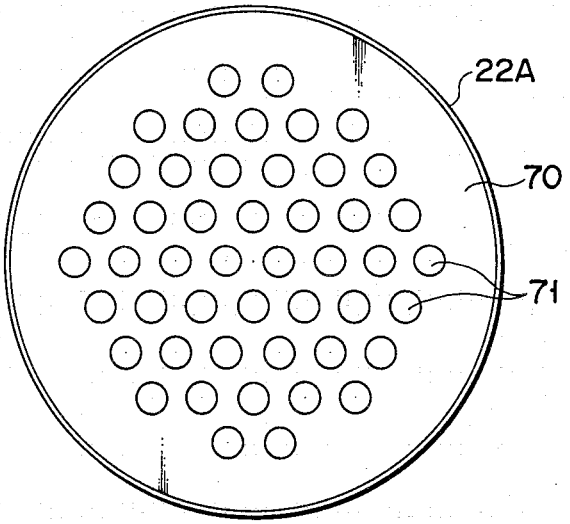
FIGS. 27 and 28 are plan views showing further modifications of the retaining cap.
Figure 28:
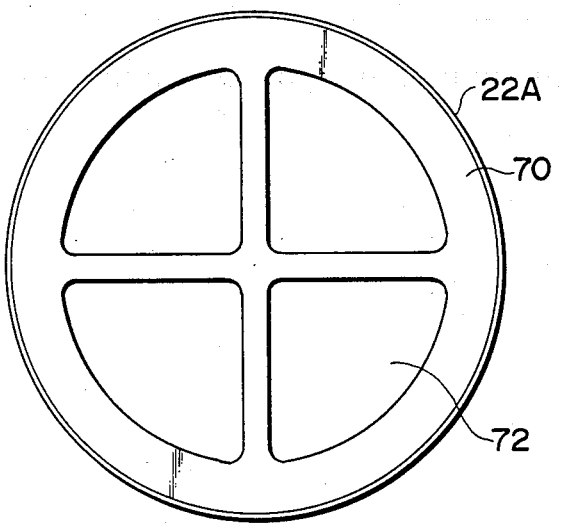

FIGS. 27 and 28 show further modifications of the screw cap.

In the embodiments or modification described above, retaining cap 22 is ring-shaped. In the modification shown in FIG. 27, however, screw cap 70 is disk-shaped, and is formed with a number of pores 71 through which the exhaust gas passes. Each pore 71 may be circular or polygonal in shape. Alternatively, cap 70 may be formed with a plurality of fan-shaped apertures 72, as shown in FIG. 28.

Figure 29:
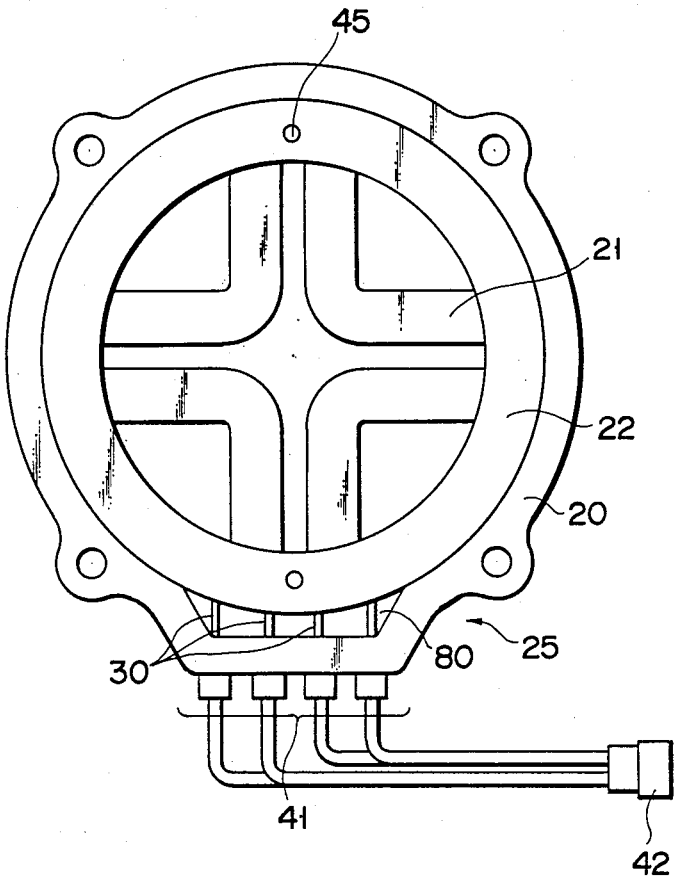
FIG. 29 is a plan view showing a modification of the heater case.

FIG. 29 shows another modification of heater case 20. In this modification, terminal mounting portion 25, protruding outward from case 20, is formed with notch 80, whose inner and top faces are open. Notch 80 facilitates the connection of lead wires 30 to terminals 41.

In this case, internal thread portion 27 on the inner peripheral surface of heater case 20 is cut, in the middle, by notch 80. However, the remaining part of thread portion 27 is long enough to hold retaining cap 22 securely.

In the embodiments described above, insulating ring 23 is circumferentially divided in two. Alternatively, however, it may be divided into three or more parts, or formed into a single, integral body.

In the above embodiments, moreover, insulating ring 23 used is one in number. Alternatively, two such insulating rings may be arranged in the axial direction, so as to hold heater element 21 between them. In this case, the insulating film, formed by ceramic coating, can be omitted.

According to the third embodiment, as described above, ceramic insulating ring 23 and conductive-ceramic heater elements 21 are held between protrusion 26 on heater case 20 and retaining cap 22. Accordingly, ring 23 and elements 21 are pressed under a substantially uniform surface pressure. Even if vibration or impact is applied to the insulating ring, therefore, the ring will not be subjected to concentrated stress, thus avoiding cracking and reduced clamping force, and enjoying a prolonged life.

What is claimed is:

1. An exhaust-gas purifying apparatus comprising:

filter means for trapping exhaust-gas particulates from an engine, said filter means first and second ends;

filter housing means for holding the filter means, said filter housing means having an inlet, corresponding to said first end of said filter means, and an outlet, corresponding to said second end of said filter means, so that exhaust gases are directed to pass through said filter means; and heater means for heating and burning particulates trapped in the filter means, said heater means comprising:

a heater case mounted and so arranged on said filter housing means to be positioned between said inlet and said first end of said filter means;

one or more conductive-ceramic heater elements connected to and extending from said heater case so as to be arranged in the vicinity of the first end of said filter means to form passages for the exhaust-gas, said heater element having a first fixed end rigidly attached to the heater case, said fixed end including a first electrode member brazed thereto, and a second slidable end including a second electrode fixedly attached thereto; and support means for slidably holding said second slidable end against the heater case to enable sliding motion of said second end resulting from thermal deformation when electricity is allowed to pass through and heat said element.

2. The apparatus according to claim 1, wherein said second electrode member, movable relative to the heater case, is brazed to the second slidable end of said heater element so as to be attached by solidified molten solder, said second electrode member having a projection, the tip end of which is connected with a lead wire.

3. The apparatus according to claim 2, wherein said first and second electrodes communicate with said exhaust gases by means of a communicating passage.

4. The apparatus according to claim 2, wherein said heater case is substantially cylindrical and has an inwardly directed peripheral protrusion and wherein said heater means further comprises;

an insulating ceramic ring having through holes for receiving the slidable end of said heater element, and a guide groove for guiding the lead wire connectd thereto to an external electrical terminal so that first and second ends of the heater elements are placed in an electrically insulated manner against said ring-shaped protrusion of the inner peripheral surface of the substantially cylindrical heater case, and are held in position by a retaining cap which presses against the insulating ring, said retaining cap having an external threaded portion engaging an inner peripheral surface of the heater case, so that the first fixed end of said heater element is fixed to the protrusion.

5. The apparatus according to claim 4, wherein said first fixed ends of said heater elements are held by the insulatng ring through the medium of a button-shaped cushion member having an insulating member thereon, at a position removed from the location of the electrode members.

6. The apparatus according to claim 4, wherein said heater element has a substantially V-shaped configuration, the two legs of which correspond to the first fixed and second slidable ends, individually.

7. The apparatus according to claim 2, wherein said second electrode member includes a flange portion and a trunk portion, and passes through an insertion hole in the second slidable end of said heater element, an end of said trunk projecting from one side of the second slidable end of said heater element when the flange engages the other side, so that the second slidable end of said heater element is clamped between the flange and a fixing member associated with the projecting end of the trunk.

8. The apparatus according to claim 7, wherein said heater element has a honeycomb configuration.

* * * * *